US005287160A

United States Patent [19]

Dastin et al.

[11] Patent Number: 5,287,160

[45] Date of Patent: Feb. 15, 1994

[54] REGISTRATION IMPROVEMENT BY COMPONENT SYNCHRONIZATION IN COLOR PRINTERS

[75] Inventors: Richard M. Dastin, Fairport; Vittorio R. Castelli, Yorktown Heights, both of N.Y.

[73] Assignee: Xerox Corporation, Stamford, Conn.

[21] Appl. No.: 731,599

[22] Filed: Jul. 17, 1991

[51] Int. Cl.[5] ..... G03G 15/01

[52] U.S. Cl. ..... 355/326 R; 355/210; 355/212; 355/275

[58] Field of Search ..... 355/317, 326, 327, 210–212, 355/217, 272, 281, 245, 275, 200; 118/645

[56] References Cited

U.S. PATENT DOCUMENTS

| | | | |
|---|---|---|---|
| 4,396,275 | 8/1983 | Oka et al. | 355/212 |
| 4,531,828 | 7/1985 | Hoshino | 355/317 |
| 4,652,115 | 3/1987 | Palm et al. | 355/327 |
| 4,712,906 | 12/1987 | Bothner et al. | 355/317 X |
| 4,788,572 | 11/1988 | Slayton et al. | 355/317 |
| 4,847,660 | 7/1989 | Wheatley, Jr. et al. | 355/326 X |
| 4,884,105 | 11/1989 | Joseph et al. | 355/212 |
| 4,899,196 | 2/1990 | Mahoney | 355/317 X |
| 4,933,727 | 6/1990 | Mizuma et al. | 355/327 |
| 4,937,635 | 6/1990 | Paxon et al. | 355/326 |
| 4,937,664 | 6/1990 | Chiku et al. | 355/327 X |
| 4,961,089 | 10/1990 | Jamzadeh | 355/212 X |
| 4,965,597 | 10/1990 | Ohigashi et al. | 355/327 X |

FOREIGN PATENT DOCUMENTS

| | | | |
|---|---|---|---|
| 281055 | 9/1988 | European Pat. Off. . | |
| 387919 | 9/1990 | European Pat. Off. . | |
| 61-83557 | 4/1986 | Japan | 355/317 |
| 61-156162 | 7/1986 | Japan | 355/200 |
| 62-239178 | 10/1987 | Japan | 355/212 |
| 88/05563 | 7/1988 | World Int. Prop. O. . | |
| 88/05564 | 7/1988 | World Int. Prop. O. . | |

OTHER PUBLICATIONS

Patent Abstracts of Japan, vol. 10, No. 256 (P-493) Sep. 2, 1986 & JP-A-61 083 557 (Canon K.K.) Apr. 28, 1986.

Patent Abstracts of Japan, vol. 14, No. 153 (P-1026) Mar. 23, 1990 & JP-A-02 012 271 (Sharp Corp.) Jan. 17, 1990.

Patent Abstracts of Japan, vol. 13, No. 253 (P-883) Jun. 13, 1989 & JP-A-01 052 175 (Ricoh Co. Ltd.) Feb. 28, 1989.

*Primary Examiner*—A. T. Grimley
*Assistant Examiner*—Shuk Y. Lee
*Attorney, Agent, or Firm*—Oliff & Berridge

[57] ABSTRACT

A color printing system achieves enhanced registration of a plurality of color separations. A plurality of color separation images are formed on a receptor in spaced relationship to one another, the distance between the leading edges of successive images corresponding to a pitch distance. The motion components of the system have circumferences which are equal to or a submultiple of the pitch distance. Any systematic errors due to motion of the components will repeat themselves identically for each color separation and eliminate misregistration.

14 Claims, 5 Drawing Sheets

REGISTRATION IMPROVEMENT BY COMPONENT SYNCHRONIZATION IN COLOR PRINTERS

BACKGROUND OF THE INVENTION

1. Field of the Invention

The present invention relates to color printers or copiers which perform a plurality of color separations and, more particularly, to color printers which perform a plurality of color separations in which registration of the color separations is ensured.

2. DESCRIPTION OF THE RELATED ART

In color printing, successive images corresponding to each of a plurality of colors, i.e., color separations, are formed. Each single color separation is transferred to a copy sheet in superimposed registration with any prior single color image. The registered relationship of the single color images creates a multi-layered image on the copy sheet Thereafter, the multi-layered image is permanently affixed to the copy sheet, thus creating a color image.

The achievement of good copy quality using a color printer is largely dependent on the attainment of good relative registration of the various color separations forming the image. Otherwise, blurred images will result.

Color printers generally incorporate a plurality of subsystems. Examples of these subsystems are receptor loops for handling latent images, receptor loops for handling developed images, image development subsystems and image transfer subsystems. Since a plurality of subsystems cooperate to form each color separation of a single image, it is particularly difficult to establish with adequate precision the spacial position of the color separations at any given instant of time and, particularly, when color separation registration is performed.

One factor contributing to this difficulty in establishing precise color separation registration is the non-perfect cylindricity of various components of the subsystems. Another contributing factor is the eccentric location of rotating shafts about which roller components of the color printer rotate, thus causing roll run out which induces a wobble-like roller rotation Accordingly, even when components of the subsystems are driven at a perfectly constant rotational speed, the linear motion will not necessarily be uniform throughout these subsystems.

The related art has proposed techniques for improving the relative registration of various color separations.

U.S. Pat. No. 4,712,906 to Bothner et al discloses a color printer which reproduces a multi-color image and improves registration between the formation of each image. The improvement in registration is attained by utilizing a transfer drum which has a circumference substantially equal to a distance on an image member between comparable points in consecutive images. The apparatus does not disclose synchronization throughout the components of the printer.

U.S. Pat. No. 4,652,115 to Palm et al discloses a color printer which maintains precise registration of color composite images. Registration is maintained by making the length of a belt carrying an intermediate transfer medium an integer submultiple of another belt which carries a photoreceptor. A digital electronic controller synchronizes the mechanical movements of the two belts to assure proper registration of the color component images when forming a composite image. The apparatus thus requires an additional controller to ensure registration.

U.S. Pat. No. 4,847,660 to Wheatley, Jr. et al discloses a method and apparatus for registration control. Registration and synchronization between a photoreceptor web and an image receiving web is maintained by separate motors which drive the webs under the control of independent servo mechanisms. Each of the servo mechanisms is controlled to drive the respective web such that the webs have constant rotational periods. The relationship between the constant rotational periods is equal to the relationship between the lengths of the webs. Since the photoreceptor and image receiving webs have a ratio of lengths nominally equal to an integer, the relationship between the constant rotational periods is nominally an integer. The device, however, does not ensure uniform motion throughout the individual components of the printer.

U.S. Pat. No. 4,788,572 to Slayton et al discloses a dual belt synchronization system for a color printer which provides enhanced image registration. Each belt is independently driven by a DC electric motor. A digital electronic controller synchronizes the mechanical movements of the two belts to assure proper registration of color images when forming a composite image. A length of one of the belts is nominally an integer submultiple of the length of the other belt. The system achieves proper registration by synchronizing angular velocities around rollers. The synchronization of angular velocity, does not, however, create uniform motion in all subsystems of the printer. Further, the system requires an additional controller.

U.S. Pat. No. 4,965,597 to Ohigashi et al discloses a color image recording apparatus which forms a composite color image on a recording medium. The apparatus includes registration marks formed on the recording medium at equal pitches as the recording medium is transported through an image formation device. The apparatus measures each pitch between registration marks and compensates, for each interval between the registration marks, for a discrepancy between the measured pitch and the number of lines assumed when the registration marks were formed. The recording medium does not provide synchronous motion of all printer subsystem components.

U.S. Pat. No. 4,933,727 to Mizuma et al discloses a color recording apparatus comprising a timing control system which controls the timing of exposing an optical image to a photoconductor belt. The timing is synchronized with rotation of a drive roller of the photoconductor belt so that a cycle of an exposure operation is equal to a value of one cycle of the driver roller multiplied by a number of rotation. The device thus only controls exposure timing in accordance with rotation of a single drive roller of the photoconductor belt.

U.S. Pat. No. 4,961,089 to Jamzadeh discloses a web tracking apparatus wherein a lateral movement of the web in a direction transverse to the direction of movement of the web along a path is monitored, and signals are generated in response thereto. In response to the signals, a determination is made whether an operation can be performed upon the web without imposing a correction to the lateral web movement. The device thus requires sensing of web movement in a plurality of directions.

U.S. Pat. No. 4,937,664 to Chiku et al discloses an image forming apparatus which eliminates a possible image misregistration in each image station. The apparatus detects register marks formed by each image forming station. When misregistration occurs, a correcting means begins operation at a predetermined time which is independent from the image forming sequence of each image forming station. The misregistration is corrected without causing a rate of operation of the apparatus to decrease. Accordingly, the apparatus requires the use of an additional correcting means.

U.S. Pat. No. 4,937,635 to Paxon et al discloses a reproduction apparatus which corrects registration errors. Reproductions of reproductions are enlarged and examined for image registration. Appropriate adjustments are made in the timing of process steps to provide a registration suitable for high quality image reproduction. This apparatus requires the production of additional reproductions for examination purposes, thus increasing the time required to produce an image.

While the related art attempts to improve color separation registration in a color printer, the art proposes no structure for achieving this goal which is effective for all subsystems of the printer without requiring additional timing control devices, perfect synchronization and/or perfectly designed components.

OBJECTS AND SUMMARY OF THE INVENTION

An object of the present invention is to provide superior copy quality using a color printer.

Another object of the present invention is to provide good relative registration of a plurality of color separations when forming an image using a color printer Another object of the present invention is to provide a color printer with improved color separation registration without requiring additional printer components.

Another object of the present invention is to provide a color printer with improved registration of color separations without adding time or expense to an image forming operation.

A further object of the present invention is to provide improved color separation registration in a variety of color printing systems.

To achieve the foregoing and other objects and to overcome the shortcomings discussed above, a color printing system is provided which achieves enhanced registration of a plurality of color separations. A plurality of color separation images are formed on a receptor in spaced relationship to one another prior to transfer to an output sheet. The distance between the leading edge of successive images corresponds to a predetermined pitch distance. Various motion components of the color printer each have a circumference which is either equal to or a submultiple of the predetermined pitch distance. Accordingly, any systematic error due to motion of the printer components will repeat itself in an essentially identical manner for each color separation, thus eliminating misregistration of the plurality of color separations.

BRIEF DESCRIPTION OF THE DRAWINGS

The invention will be described in detail with reference to the following drawings in which like reference numerals refer to like elements and wherein.

DETAILED DESCRIPTION OF PREFERRED EMBODIMENTS

Figure 1:
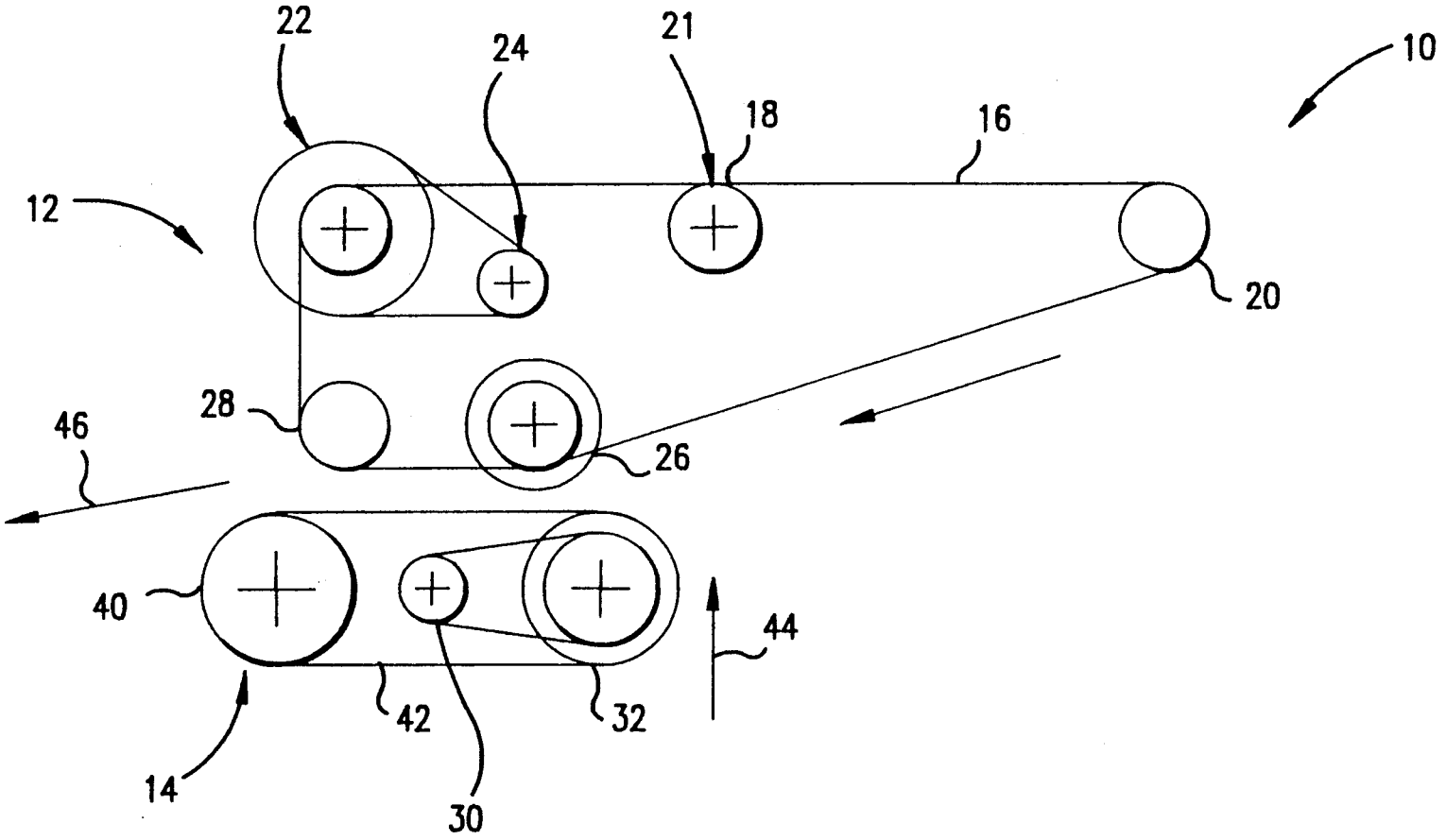
FIG. 1 is a schematic diagram of a color printer according to the present invention.

Referring now to the drawings, color printers having improved registration of a plurality of color separations according to the present invention are now described.

FIG. 1 illustrates a color printer 10 having a receptor loop 12 and a two roll transfer loop 14. Receptor loop 12 includes a photoreceptor belt 16 provided on a plurality of spaced, rotating rollers 18, 20, 22, 26 and 28. A servo motor 24 cooperates with drive roller 22 to control rotation of the rollers to provide movement of photoreceptor belt 16 around receptor loop 12. A 6/1 gear reduction is provided at drive roller 22. A remote encoder is provided at roller 26. The remote encoder keeps track of the total travel of photoreceptor belt 16.

Exposure 21 is performed on photoreceptor belt 16 at a location adjacent roller 18. As described with reference to FIG. 2, the exposure can be formed in the following manner. As an original is scanned by a light source, light reflected from the light source and filtered in accordance with a particular color separation image can be provided to a polygon spinner 50. Polygon spinner 50 reflects the light through lens 56 to photoreceptor belt 16. Accordingly, each of a plurality of color separation images are formed in a successive manner on photoreceptor belt 16.

Two roll transfer loop 14 includes a transfer belt 42 positioned on spaced rotating rollers 40 and 32. A servo motor 30 controls rotation of roller 32, roller 40 then following the rotation of roller 32. In this example, the servo motor 30 of two roll transfer loop 14 maintains a 6/1 pulley reduction.

The color printing operation is formed by feeding an output sheet at an infeed 44. The color separation images formed on photoreceptor belt 16 are transferred to the output sheet at a transfer location between receptor loop 12 and transfer loop 14. Subsequently, the output sheet is directed to outfeed 46. The transfer of the plurality of color separations forming the composite image preferably occurs at the same location to provide registration of the separation images.

In the above example, color separation registration can be ensured in accordance with the present invention in the following manner. In the receptor loop 12, the photoreceptor rolls can be synchronized to two different image pitch lengths. For example, when A4 long edge feed paper is used as the output sheet, three latent images can be processed per single revolution of photoreceptor belt 16. Thus, the image pitch length for the A4 long edge feed paper is one-third of the circumference of the photoreceptor loop 12. In the above example, the circumference of the photoreceptor loop is 45 inches. Accordingly, the pitch length is 15 inches. The five major rollers in the receptor loop 12, i.e., rollers 18, 20, 22, 26 and 28 are preferably a submultiple of the image pitch length. In this example, the circumference of each of the five major rollers is 3.75 inches. The five major rollers 18, 20, 22, 26 and 28 will rotate exactly four times for each 15 inch image pitch.

Likewise, in using A3 short edge feed paper, a different image pitch length will be provided. For the A3 short edge feed paper and the same photoreceptor loop circumference of 45 inches, the pitch length between the leading edge of successive latent images will be 22.5 inches. The five major rollers of 18, 20, 22, 26 and 28 of the receptor loop 12 will each rotate exactly six times for each 22.5 inch image pitch. As seen above with reference to FIG. 1, by providing the five major rollers 18, 20, 22, 26 and 28 of the receptor loop 12 with a diameter of 1.194 inches corresponding to a 3.75 inch circumference, the photoreceptor motion can be synchronized for a plurality of color separations. Thus, even if the rollers of the receptor loop 12 are imperfectly formed, off-center, etc., any motion errors contributed to these components will repeat themselves identically for each color separation. The roller run out or wobbling roller motion due to an eccentric roller shaft, does not, accordingly, cause color separation misregistration since the frequency of any roller run out will be synchronized to the length of an image pitch.

The two roll transfer loop 14 can also be provided with synchronized motion by including rollers 32 and 40 each having a circumference which is a submultiple of the circumference of the transfer belt 42. For example, if the circumference of the transfer belt 42 is 570 millimeters, the circumference of each of the rollers 32 and 40 can be 285 millimeters, one-half of the transfer belt circumference. Accordingly, synchronized motion of the transfer loop 14 will also be provided.

In the color printer of FIG. the process direction during the exposure cycle is the direction of motion of the photoreceptor belt 16 as shown by the arrow adjacent belt 16. Color misregistration can also occur perpendicular to the process direction, i.e., the fast scan direction, during an exposure cycle using a polygon raster output scanner imaging system. The raster output scanner writing occurs directly on roller 18, i.e., a backup roller which, as discussed above with respect to FIG. 1, is 3.75 inches in circumference. As a result of roller run out, or a wobbling motion of the rotating roller, the perfect image plane 52, as shown in FIG. 2, will not be stable in the vertical direction, i.e., the up and down direction of FIG. 1 and the left and right direction of FIG. 2.

Figure 2:
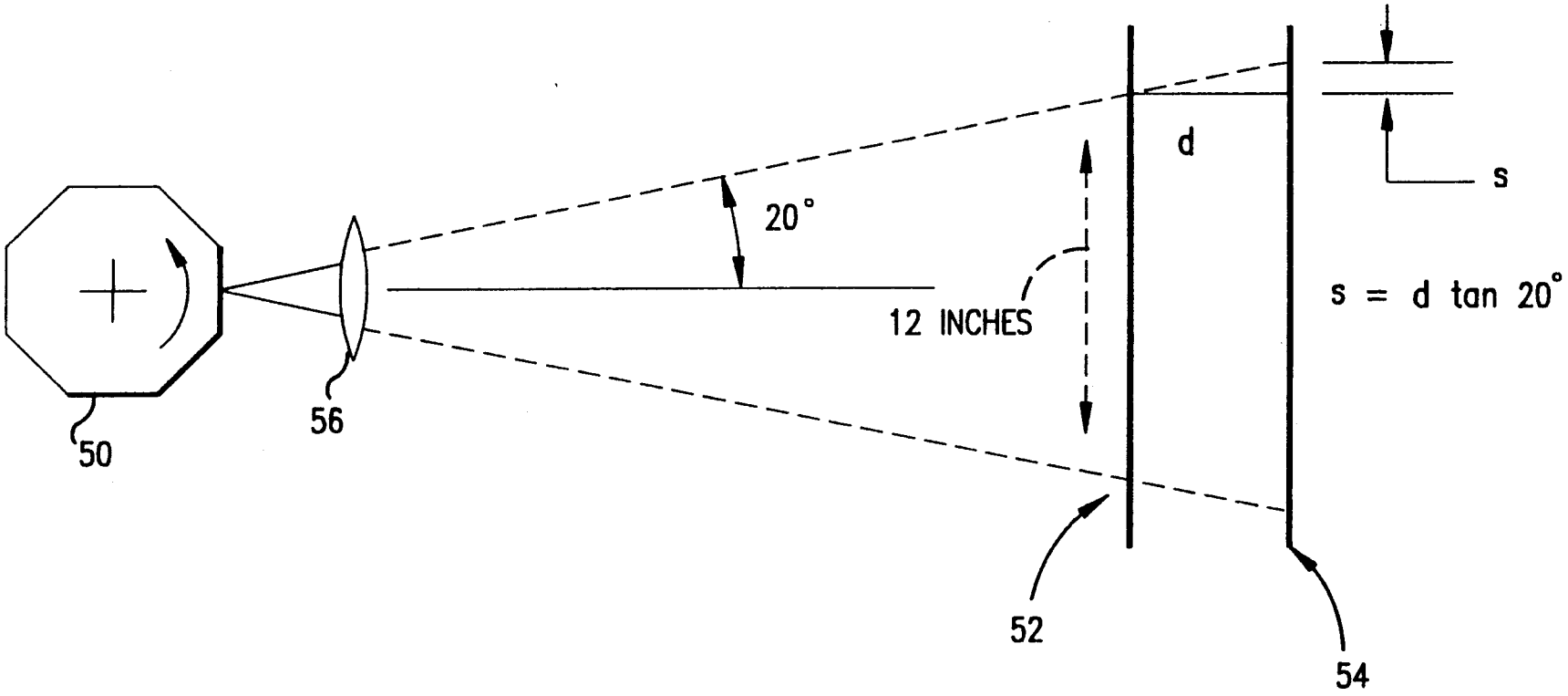
FIG. 2 is a diagram of the exposing subsystem of the printer of FIG. 1.

As shown in FIG. 2, the imaging angle at the extreme ends of the copy is, in this example, typically 20°. Due to this angle, changes in the conjugate length due to roller run out will create image placement errors in the fast scan direction perpendicular to the process direction. The amplitude of the placement error is:

$$s = d \times \tan 20° = 0.36 \times d,$$

where d is run out amplitude.

If the exposure backup roller 18 has a run out amplitude d of 0.006 inches, the possible amplitude of the misregistration error is 0.002 inches. If the total allowable misregistration is, for example, 0.005 inches, the error of 0.002 inches can be beyond an allowable scope. Accordingly, by using a backup roller 18 having a synchronous circumference, in this example, 3.75 inches, the run out of roller 18 becomes noncritical since any image distortion will now be synchronized for each color separation. Accordingly, misregistration of color separations will not occur.

Figure 3:
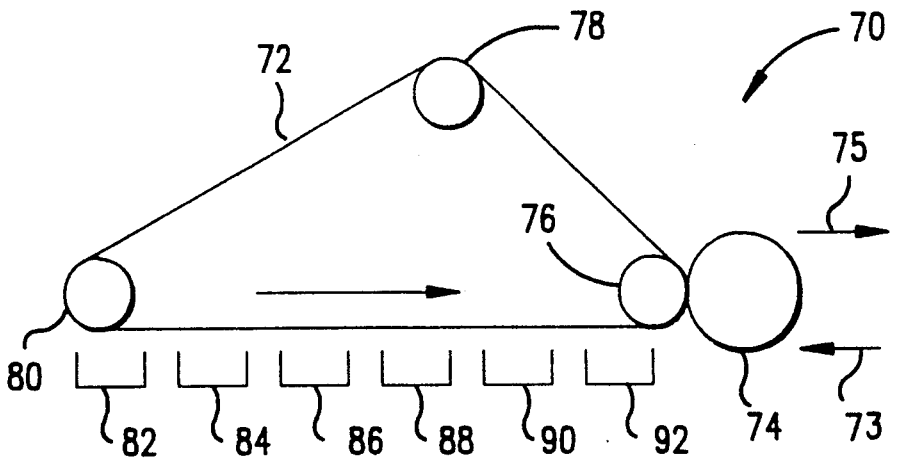
FIG. 3 is a schematic diagram of a second embodiment of a color printer according to the present invention.

FIG. 3 illustrates a color printer embodiment 70 wherein a receptor belt 72 is positioned about spaced rollers 76, 78 and 80. The rollers 76, 78 and 80 rotate to move receptor belt 72 in the direction indicated by the arrow within the loop. Successive images corresponding to each of a plurality of color separations are formed on receptor belt 72. For example, a charge device 82 can charge the receptor belt 72 for receipt of an image. Thereafter, a single direct writing head 84 can form a series of successive images on belt 72. Each image formed on belt 72 by writing head 84 corresponds to a single color separation used in forming a composite image. Following formation of the image on belt 72 by writing head 84, the appropriate developer 86, 88, 90 or 92 develops the image. For example, for a single image comprising four color separations, following charging of the receptor belt 72 by charge device 82, the first image will be formed on belt 72 by writing head 84 and developed by developer 86. An output sheet will be fed at infeed 73 of a paper path. The first image will be transferred to the output sheet as the output sheet and image on belt 72 contact one another between transfer roller 74 and backup roller 76. The output sheet will then pass through outfeed 75 and refed at infeed 73. The second color separation will be provided by writing the appropriate image on belt 72 using writing head 84 following charging of the receptor belt 72 by charge device 82 and developing the image using developer 88. The second color separation image will be transferred to the output sheet refed at infeed 73 from belt 72 as the output sheet passes between rollers 74 and 76. The two remaining images will be provided to the output sheet in a likewise manner.

Figure 5:
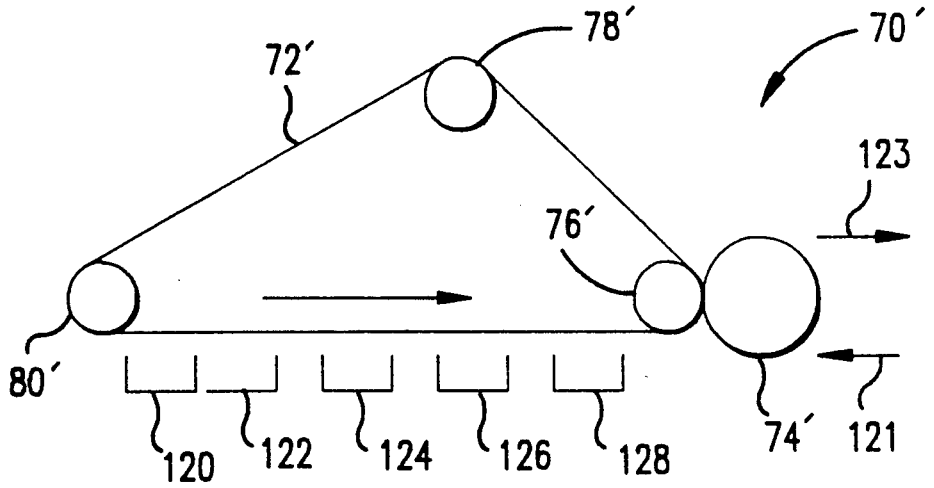
FIG. 5 is a schematic diagram of a fourth embodiment of a color printer according to the present invention.

FIG. 5 discloses a similar color printer 70'. Printer 70' also includes a belt 72' which is provided on spaced rollers 76', 78' and 80'. Printer 70' also includes a transfer roller 74'. Belt 72' is charged by a charge device 120. Stations 122, 124, 126 and 128 are provided in spaced relationship along receptor belt 72'. The FIG. 5 embodiment differs from the FIG. 3 embodiment in that each station 122, 124, 126 and 128 forms and develops a color separation image. Accordingly, an image is formed on receptor belt 72' for each color separation at the appropriate station and is developed at that same station. The output sheet is fed through infeed 121 for transfer of the color separation image as the output sheet passes between rollers 74' and 76' to be fed through outfeed 123.

In the FIG. 3 and FIG. 5 embodiments, the circumference of the receptor rollers 76, 78 and 80 and 76', 78' and 80' and the transfer roller 74 and 74' are preferably equal to or a submultiple of the distance between the leading edge of successive images formed on receptor belt 72 or 72'. Accordingly, any motion errors caused by any of the printer components will repeat themselves essentially identically for each color separation, thus eliminating misregistration of the color separations.

Figure 4:
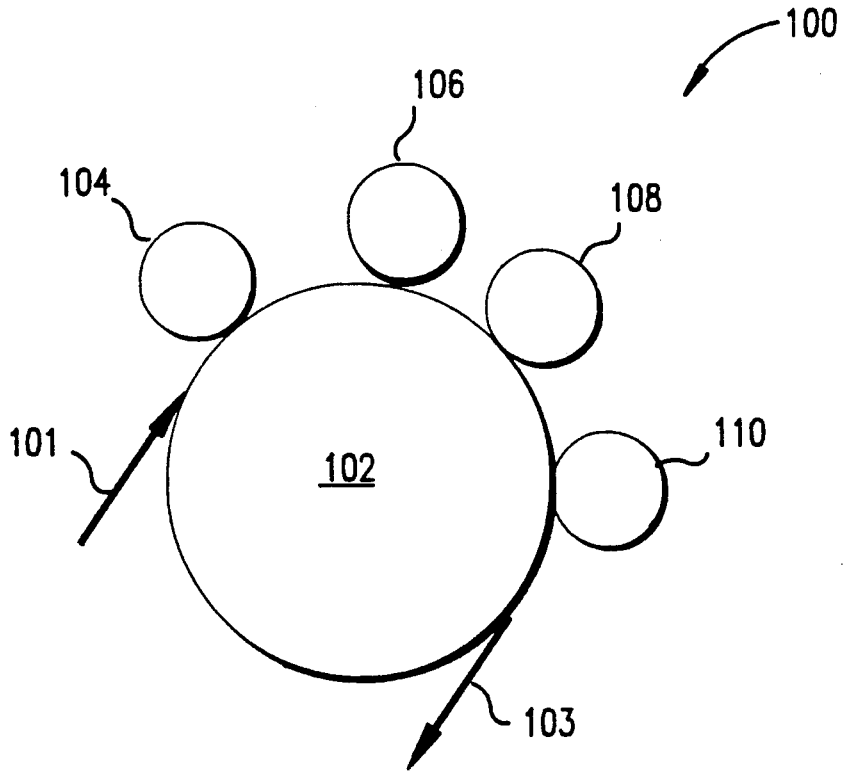
FIG. 4 is a schematic diagram of a third embodiment of a color printer according to the present invention.

FIG. 4 illustrates a color printer embodiment 100 including a conveyor drum 102 which grips and conveys an output sheet received from infeed 101 and conveys the sheet to outfeed 103. A plurality of image forming stations 104, 106, 108 and 110 having, for example, photoreceptor drums, each provide a color separation on the output sheet. The color separations provided by image forming stations 104, 106, 108 and 110 are superposed in registered relationship to form a composite color image. To ensure registration of the images on the output sheet, the drums forming the image forming stations and the conveyor drum 102 are preferably equal to or a submultiple of the distance between the leading edge of successive images as they are formed on the output sheet. Accordingly, the synchronization of the printer components will minimize the mechanical errors affecting registration of the color separations.

Figure 6:
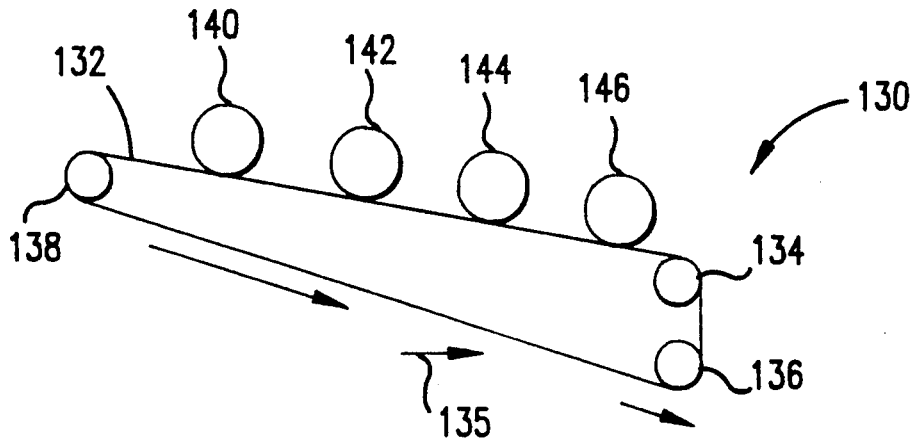
FIG. 6 is a schematic diagram of a fifth embodiment of a color printer according to the present invention.

FIG. 6 shows an example of a color printer 130 which has a plurality of image forming stations 140, 142, 144 and 146 positioned about a receptor belt 132. Belt 132 is rotated in a counterclockwise direction by spaced rollers 134, 136 and 138. Images are formed on the receptor belt 132 by each of the image forming stations 140, 142, 144 and 145 to provide a plurality of color separations which are superposed to form a composite color image. An output sheet is provided for transfer of each of the color separations at a position 135 adjacent the receptor belt 132. In this embodiment, the circumference of rollers 134, 136 and 138 is equal to or a submultiple of the pitch between the images formed at each of the stations 140, 142, 144 and 146. Accordingly, any motion errors are minimized, thus eliminating misregistration of the color separation images.

Figure 7:
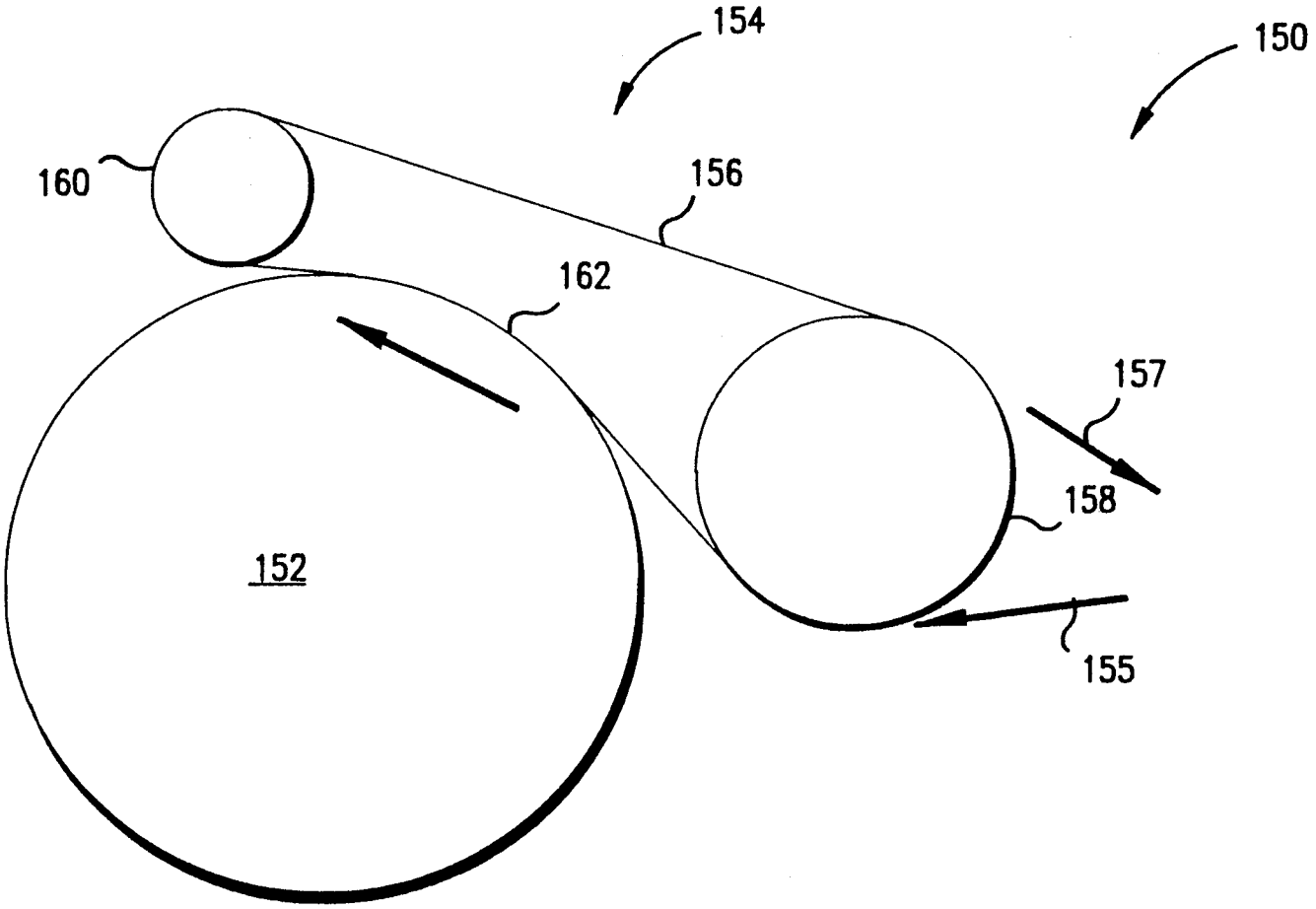
FIG. 7 is a schematic diagram of a sixth embodiment of a color printer according to the present invention.

FIG. 7 illustrates a further color printer embodiment 150 having a photoreceptor drum 152 and a transfer loop 154. The transfer loop 154 includes spaced rotating rollers 158 and 160 and a transfer belt 156 positioned about spaced rollers 158 and 160 An output sheet is fed through infeed 155 to a transfer zone 162 at which a color separation is transferred to the output sheet. The output sheet then moves along belt 156, and turns around at roller 160. To form a composite image, the output sheet is successively transported around transfer loop 154 until each of the color separations is provided thereon.

To ensure registered relationship of the color separations, the photoreceptor drum and the rollers 158 and 160 each have a circumference which is equal to or a submultiple of the distance between the leading edge of the successive images provided on the photoreceptor drum 152. Accordingly, any motion errors attributable to any of these components will repeat themselves identically for each color separation, thus eliminating misregistration of color separations.

The synchronized motion of the components of the above-described color printers thus eliminate registration errors caused by inaccurate superpositioning of color separations forming a composite image. In making the circumference of each component equal to or a submultiple of any color separation pitch, the effects of any imperfections due to the imperfect manufacture or operation of the components is reduced. All systematic motion errors repeat themselves essentially identically for each color separation. The motion of the printer components is substantially synchronous. The synchronism need not be perfect but is preferably limited to a small fraction of a cycle of the printer component which operates at the highest frequency.

The superposed registration is achieved without requiring precise manufacture of the printer components. Accordingly, the superposed registration is achieved in a cost effective manner.

While this invention has been described in conjunction with specific embodiments thereof, it is evident that many alternatives, modifications and variations will be apparent to those skilled in the art. For example, while the invention is described with reference to color printers, the synchronization can be performed with a copier. Accordingly, the preferred embodiments of the invention as set forth herein are intended to be illustrative, not limiting. Various changes may be made without departing from the spirit and scope of the invention as defined in the following claims.

What is claimed is:

1. A color printer which performs a plurality of color separations for an image, said color separations being superposed on one another in registered relationship to form said image, said color printer comprising:

receptor means for receiving a different image for each color separation, said receptor means being provided on at least one roller, a leading edge of successive images on said receptor means being spaced by a predetermined pitch distance, a circumference of each said roller on which said receptor means is provided being one of equal to and a submultiple of said pitch distance; and transfer means cooperating with said receptor means for transferring each said image to an output sheet in superposed, registered relationship.

2. The color printer according to claim 1, wherein said receptor means comprises a belt provided on a plurality of spaced rollers, a circumference of each of said spaced rollers being one of equal to and a submultiple of said pitch distance.

3. The color printer according to claim 1, wherein said transfer means comprises at least one roller for conducting said output sheet to contact said receptor means, a circumference of said at least one roller of said transfer means being one of equal to and a submultiple of said pitch distance.

4. The color printer according to claim 2, wherein said receptor means comprises an electrostatically charged receptor belt.

5. The color printer according to claim 4, wherein said color printer further comprises:

a writing head for forming a latent image for each color separation on said receptor belt, said writing head being located adjacent said receptor belt; and developing means for developing the latent images on said receptor belt, the latent images corresponding to said color separations.

6. The color printer according to claim 5, wherein said developing means comprises a plurality of developing stations, each said developing station developing one latent image corresponding to one of said color separations for transfer by said transfer means to said output sheet.

7. The color printer according to claim 3, wherein said transfer means comprises a transfer roller and a backup roller, said receptor means passing between said transfer roller and said backup roller, said transfer roller and said backup roller each having a circumference, the circumference of each said transfer roller and said backup roller being one of equal to and a submultiple of said pitched distance.

8. The color printer according to claim 4, further comprising a plurality of image forming stations for forming developed images on said receptor belt, said image forming stations being located adjacent said receptor belt, each said image forming station forming a developed image on said receptor belt, each developed image corresponding to one of said color separations for transfer by said transfer means to said output sheet.

9. The color printer according to claim 2, further comprising a plurality of image forming stations for forming developed images on said belt, said image forming stations being located adjacent said belt, each said image forming station forming a developed image on said belt, each developed image corresponding to one of said color separations for transfer by said transfer means to said output sheet.

10. The color printer according to claim wherein said receptor means is provided on a drum, a circumference of said drum being one of equal to and a submultiple of said pitch distance.

11. The color printer according to claim further comprising exposure means for exposing said receptor means to light reflected from an original, said exposure means forming each said image on said receptor means.

12. A color printer according to claim 1, wherein the transfer means comprises a transfer belt provided on a plurality of spaced rollers, a circumference of each of said spaced rollers being one of equal to and a submultiple of said pitch distance.

13. The color printer according to claim 1, wherein the transfer means comprises a transfer belt provided on a plurality of spaced rollers, a circumference of each of said spaced rollers being a submultiple of a circumference of the transfer belt.

14. The color printer according to claim 1, wherein the receptor means comprises a plurality of drum photoreceptors, each of said drum photoreceptors provided an image corresponding to one of said color separations and having a circumference which is one of equal to and a submultiple of said pitch distance.

* * * * *